United States Patent [19]

Vural

[11] 4,127,351

[45] Nov. 28, 1978

[54] DYNAMIC SOIL COMPACTION

[75] Inventor: Gülertan Vural, Emmelshausen, Fed. Rep. of Germany

[73] Assignee: Koehring GmbH - Bomag Division, Boppard, Fed. Rep. of Germany

[21] Appl. No.: 746,102

[22] Filed: Nov. 30, 1976

[30] Foreign Application Priority Data

Dec. 1, 1975 [DE] Fed. Rep. of Germany ..... 2554013

[51] Int. Cl.[2] ..... E01C 19/34

[52] U.S. Cl. ..... 404/72; 404/133

[58] Field of Search ..... 404/133, 72, 117, 113, 404/114, 115

[56] References Cited

U.S. PATENT DOCUMENTS

| | | | |
|---|---|---|---|
| 2,938,438 | 5/1960 | Hamilton | 404/113 |
| 3,053,157 | 9/1962 | Martin | 404/117 |
| 3,075,436 | 1/1963 | McRae | 404/133 |
| 3,283,679 | 11/1966 | Rafferty | 404/117 |
| 3,598,029 | 8/1971 | Paramythioti | 404/117 |
| 3,599,543 | 8/1971 | Kerridge | 404/117 |
| 3,605,583 | 9/1971 | Keppler | 404/117 |
| 3,778,177 | 12/1973 | Haker | 404/117 |
| 3,797,954 | 3/1974 | Harris | 404/117 |
| 3,807,067 | 4/1974 | Cloud | 404/113 X |
| 3,885,883 | 5/1975 | Sieke | 404/113 X |

*Primary Examiner*—Nile C. Byers, Jr.

*Attorney, Agent, or Firm*—Spencer & Kaye

[57] ABSTRACT

Method and apparatus for controlling a dynamic soil compaction operation, involving striking the soil with vibrating compacting tools, monitoring the vibrational power generated by the tools or the current degree of soil compaction, and controlling the amplitude or frequency of the vibratory movements of the tools as a function of the value of such quantity.

12 Claims, 6 Drawing Figures

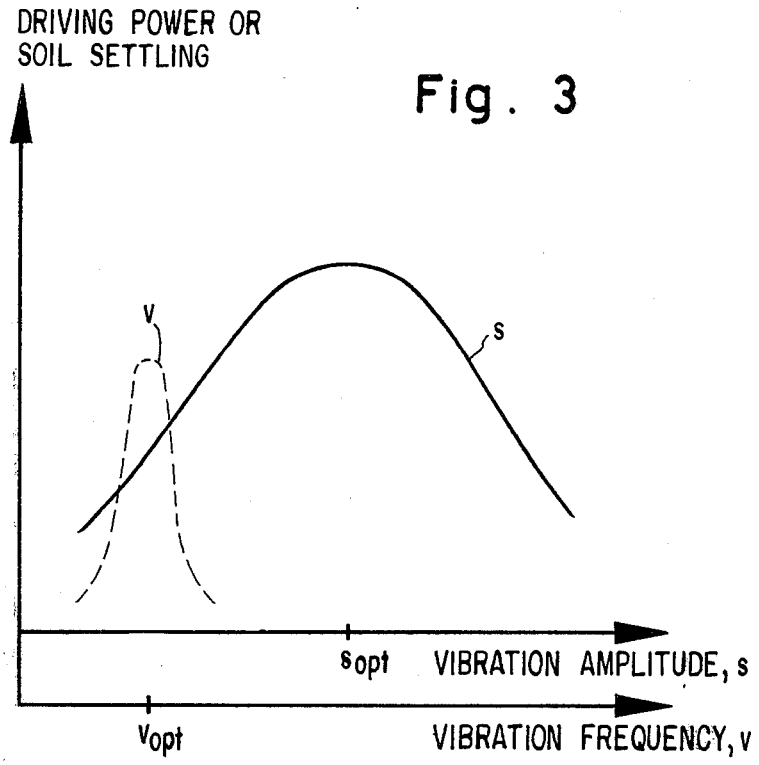
Fig. 3
Fig. 4
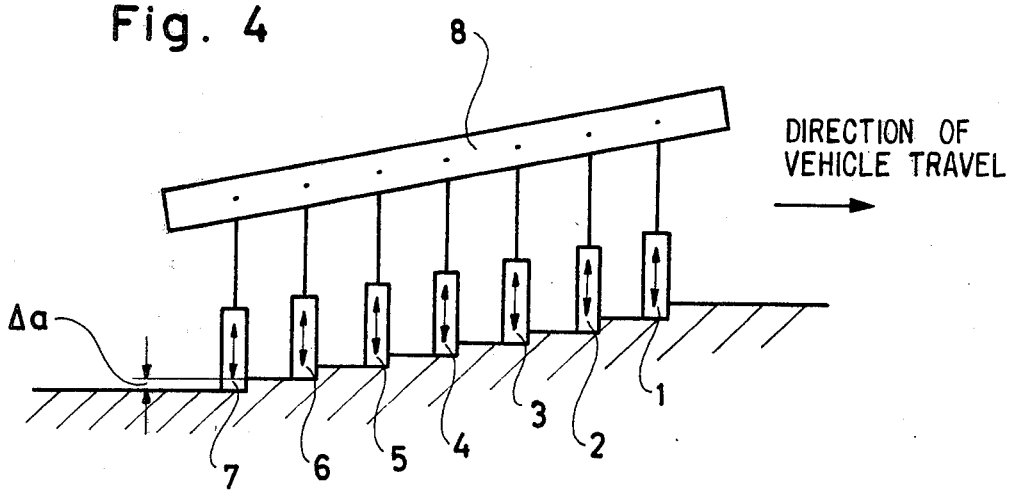

DYNAMIC SOIL COMPACTION

BACKGROUND OF THE INVENTION

The present invention relates to a method and apparatus for effectuating dynamic soil compaction by impacting the soil with vibrating masses of compacting equipment such as vibration rollers, plate vibrators, tampers, or the like.

Such procedures are known to be used for compacting fill or mixtures in earthwork, underground construction and road construction. Depending on the type of equipment employed, the vibrating masses may be subjected to vertical oscillations or may be driven by rotating eccentric weights. The latter are mainly employed in vibration rollers, which are currently in widespread use and are suitable for all compaction work, and in which one or more roller members roll over the surface to be compacted, while dynamic vibratory forces act on the roller members to produce a compaction effect which is substantially greater than if the roller acts only with its own weight.

Other types of vibrators are known, such as plate vibrators and tampers, in which, generally, the mass of the compacting tool vibrates with a certain frequency and amplitude against the frame containing the remaining structural components, but are to a large extent limited in their use and are mainly used for lighter and less extensive compaction requirements.

All previously known methods and apparatus for dynamic soil compaction have the disadvantage that the time for which the instrument is to be used in practice to achieve a required degrees of compaction is not exactly determined, and empirical values must be relied on. Continuous measurement of the soil compaction obtained, e.g. by way of the Proctor density, is not possible at the building site because of the cost, and it is necessary for safety reasons to provide a safety factor i.e., to provide an additional number of working runs, e.g. roller passes to assure that final compaction is sufficient to produce the requisite structural support. These additional runs not only result in operating costs which are unnecessarily high from the point of view of the degree of compaction, but actually create the danger of reloosening the soil.

SUMMARY OF THE INVENTION

It is therefore an object of the present invention to significantly reduce, or eliminate, the need for such safety factors while achieving a significantly more uniform compaction than was heretofore possible.

Further objects of the invention are to achieve optimization over the widest operating limits, and to reduce operating costs.

These and other objects are attained, according to the invention, by controlling the ongoing compaction procedure as a function of the value of a quantity which bears a fixed relation to the degree of compaction of the soil and which is directly measurable at the compacting equipment.

The invention makes use of the fact that the vibrational power supplied to the compacting tools is related to the compaction effect in a reproducible manner. This relationship is used during the operation of the apparatus to obtain, without any appreciable time delay, an indication of the current degree of compaction of the soil and the instantaneous compaction effect of the operating equipment, which is independent of the complicated Proctor measurement. In particular, this indication shows when further use of the equipment will serve no useful purpose, because if the vibrational power for the compacting tool or a measurable control quantity related thereto does not increase or increases only by an insignificant value, then accordingly the degree of compaction of the soil cannot increase or can increase only slightly.

Progressive compaction causes an increase in the amount of compaction energy required because more voluminous soil masses then take part in the vibration procedure. In this manner the operator is given a reliable means for determining that the several roller passes previously necessary for safety reasons may be eliminated. Likewise overlapping at the bordering region between two adjacent soil portions which have to be separately compacted, becomes unnecessary. Even in the case of those soil portions which have a higher initial density than their surroundings, considerable savings may be achieved. In this case the operator needs only to note the increase in the control quantity between successive passes, and terminate the operation of the equipment when this increase becomes uneconomically small.

The vibrational power for the compacting tool may generally be determined by measuring the torque and angular velocity of the tool drive. In the case of self-propelled compacting tools, the total drive power may also be taken as the measurable control quantity, if that proportion of the power responsible for the propulsion alone can be eliminated therefrom.

Several derived quantities related in a determined manner to the vibrational power may also be used as control quantities. Thus in the case of the most frequently used hydraulic drives, it is desirable to employ the hydraulic pressure in the pressure medium line to the compacting tool as the control quantity, provided the volumetric flow rate of the pressure medium is kept constant or corresponding account is taken of its variations. The volumetric flow is a function of the rotational speed of the hydraulic motor driving the vibrator, i.e., bears a direct relation to the desired vibrator frequency. The desired frequency depends on the state of the soil to be compacted and can be usually kept constant, in which case the hydraulic pressure will be directly proportional to the power supplied to the compacting tool, or to the soil, corresponding allowance being made for the friction losses in the vibrational drive.

The above is also true for compacting tools with linear vibration producers, wherein the real power delivered to the compacted material may be determined by measuring the effective pressure difference between the alternately fed pressure chambers of the reciprocating pressure piston. Thus the pressure difference is used as the control quantity and the influence of the quiescent or discharge pressure is substantially eliminated.

A further possibility according to the invention is to use the amount of settlement of the compacted soil at the soil surface as the control quantity. The greater the settlement occurring during the pass, the greater the compaction obtained during this pass, and vice versa. Thus if the settlement per pass measured as the control quantity falls to an uneconomically small value, this is a clear sign to the operator that further use of the apparatus will serve no practical purpose. Since the absolute values of the vibrational power and the control quantities related thereto largely depend on the state of the soil, it is desirable not to use such absolute values as the control quantities, but instead to derive the control quantities by measuring their variation while travelling over the stretches of the path, or their variation between successive passes over the same soil portion. If the change in value falls below a given amplitude, an acoustic or optical signal is emitted, or the vibrational drive is directly switched off.

For the purpose of further optimizing the compacting procedure, it is particularly advantageous if the control quantity acts on the vibration amplitude of the tools in the sense of maximizing the vibrational power, the settlement, or quantities related thereto. In this, the amplitude is automatically varied over a given range and the resultant behavior of the control quantity, such as the vibrational power, hydraulic pressure, or settlement is recorded, e.g., stored in a suitable memory device. By means of, for example, mechanical, electronic or other scanning means, which may also comprise computers, that amplitude which gives maximum compaction power is determined and set.

In this respect the following should be noted: Independently of the soil conditions, an increase in vibration amplitude causes a certain increase in the drive power because of the resulting acceleration requirements for the vibrating system and the increased resistances to movement due to the higher speed of the moving parts. This rise in drive power does not contribute to the degree of compaction, and must therefore not be counted when attempting to maximize the vibration power. It can be accounted for by way of a disturbance-variable feed-forward system in the controller, or, if applicable, in the computer, and its effect can be eliminated from the measured value so as to obtain, as the control quantity, that part of the vibrational power transmitted to the soil as real power.

If the settlement, or another quantity directly proportional to the real power, is used instead of the drive power as the control quantity, this correction is unnecessary.

In this manner, optimum adaptation of the apparatus parameters to the state of the soil is automatically obtained. The described vibration amplitude variation may take place before each new pass, or may be carried out continuously during the pass, particularly if large changes in the state of the soil are to be expected during the pass.

Compaction may be further improved if the control quantity acts on the frequency of the vibrating masses in the direction to maximize the vibrational power or settlement. In this, the vibrational frequency may be adapted to the varying resonance frequency of the soil either at the start of each new pass or continuously during the pass.

It is basically desirable to pass a signal representing the control quantity through a disturbance filter which eliminates momentary signal variations lying within given tolerance limits. This guarantees that internally produced, locally limited variations do not generate any false soil density indication.

If the change in settlement is used as the control quantity, it is advantageous to determine this change from the difference in height, relative to the soil level, between the lower inversion, or direction reversal, points, or correspondingly distinguishing points, in the vibration travel of compacting tools which are adjacent one another in the direction of machine travel. In this respect, in the case of adjacent compacting tools of the same size and having the same vibration amplitude other distinguishing points are suitable, such as the center of oscillation. As adjacent compacting tools may be of differing size or have different vibration amplitudes, the first mentioned approach gives the most reliable determination of the settlement difference. The measurement of the difference in height between the lower inversion points or, if appropriate, other corresponding distinguishing points on the compacting tool may be carried out mechanically or optically, and preferably inductively or electronically.

According to a further feature of the invention, an apparatus for dynamic soil compaction has proved suitable in which the control quantity is the settlement of the compacted soil and several compacting tools, each with an independent vibratory drive, are arranged in series in the direction of machine travel and are independent of each other with respect to their vertical vibrations. Each of these compacting tools makes one pass, in practice, so that the series arrangement of an appropriate number of compacting tools leads to a considerable shortening of the operating time. In this case, as heretofore described, each compacting tool may be provided with a control circuit for varying the vibration amplitude and/or frequency in the direction to maximum settlement.

Finally, it is particularly advantageous to use the difference in settlement between the last two compacting tools in the direction of machine travel as the control quantity for the speed of travel. If, for example, the difference in settlement is zero or uneconomically small, then the speed of travel is automatically increased until the difference in settlement rises to the given value. In contrast, if the difference in settlement is greater than this given value, the speed of travel is automatically reduced until the given value is reached. In this way all compacting tools are used to their optimum capacity.

BRIEF DESCRIPTION OF THE DRAWINGS

FIG. 3 is a diagram showing the influence of compacting amplitude and frequency variation on the drive power or settlement.

FIG. 4 is a simplified pictorial view of an arrangement of several compacting tools succeeding one another in the direction of travel.

DESCRIPTION OF THE PREFERRED EMBODIMENTS

Figure 1:
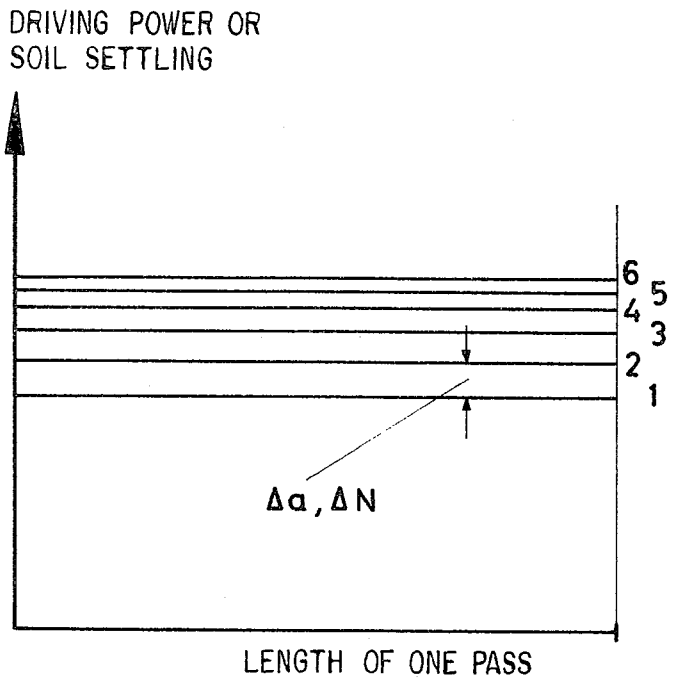
FIG. 1 is a diagram illustrating the manner in which drive power or settlement varies from one pass to the next over several successive passes.

FIG. 1 illustrates the amount of soil settlement and the drive power supplied to the compacting tools during successive passes with the tools. The height of each horizontal line corresponds to the relative magnitudes of these values during the pass whose number appears to the right of that line. Thus the greatest amount of settlement, $\Delta a$, and increase in power, $\Delta N$, occur during the first pass, and the values for these quantities decrease progressively as the number of passes increases.

FIG. 1 clearly shows that the drive power, or a quantity related thereto such as the feed pressure in the case of hydraulically driven compacting tools or the settlement produced by adjacent compacting tools, increases with increasing compaction by a determinable relative amount, for example $\Delta N$ for the power increase or $\Delta a$ for the settlement increase. Either increase approaches a limiting value asymptotically, as is shown more clearly in FIG. 2.

Figure 2:
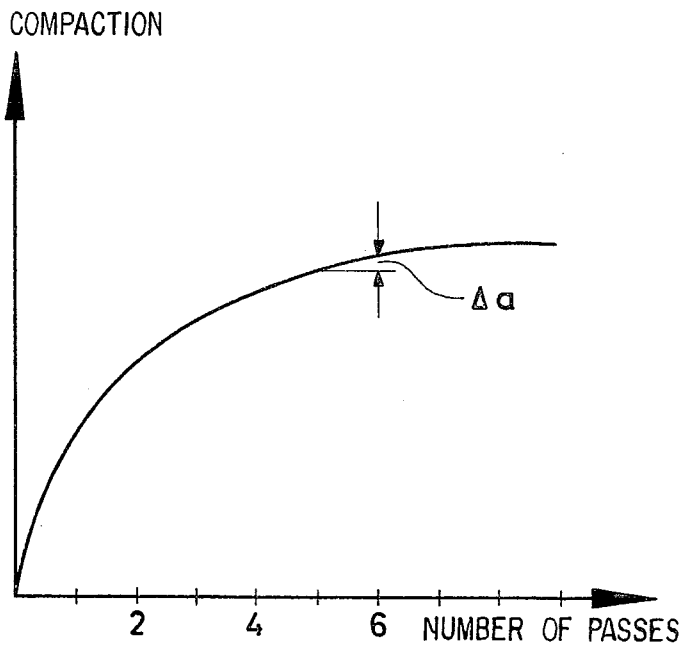
FIG. 2 is a diagram derived from FIG. 1 and depicting the relation between compaction and the total number of passes.

FIG. 2 provides a curve illustrating the relation between total compaction and the number of passes.

By monitoring the drive power, amount of soil settlement, or a quantity related thereto for controlling the compaction process in accordance with the invention, the operator is able to recognize when further passes with the compacting equipment will no longer produce any useful result. Thus for example, as can be seen from FIG. 2, a determined minimum value, $\Delta a$, may be set, for example, for the increase in settlement between successive passes, below which a signal is automatically emitted for interrupting further compaction.

FIG. 3 shows the relation existing between drive power or amount of settlement, taken along the ordinate, and vibration amplitude and frequency variation taken along the abscissa, this relating to a further development of the invention. Generally the frequency $v$ is set according to the state of the soil, to $v_{opt}$ with a tolerance of several cycles per second. Then, keeping the frequency fixed, the vibration amplitude is varied over a given range, and the amplitude $s_{opt}$ for which the compaction effect, e.g. on the basis of the measured drive power, has its maximum value is set by means of known control or regulating equipment. The amplitude and frequency variation may be effected by known methods. The amplitude is mostly varied by making changes in the geometry of the out-of-balance system. This procedure may be carried out at the beginning of each new pass during a predetermined entry stretch, the amplitude then being kept constant at the determined value for the whole of this pass. However, continuous feedback control during the complete pass is also possible.

The situation is similar with respect to frequency variation. However, since the frequency is subjected to considerably smaller variations due to the state of the soil, it is generally sufficient to adjust the frequency only at the beginning of a new pass. In this respect it is recommended to hold one or other of the two quantities, amplitude and frequency, constant while the other quantity is varied.

With respect to FIGS. 1, 2 and 3, it should further be pointed out that the illustrated curves represent ideal cases and in practice considerable distrubance variables will arise which must firstly be filtered out by known methods.

In this respect, those variables deriving from starting procedures must in particular be eliminated.

FIG. 4 is a diagrammatic illustration of an arrangement according to the invention of several compacting tools 1 to 7 mounted in a common frame 8 of a compacting machine to be disposed one after the other in the direction of machine travel. Each compacting tool can have its vertical position relative to the frame 8 adjusted so that variations in its level of vibration are controlled exclusively be the soil level, independently of the position of the frame. The compacting tools assume an increasingly deeper or lower position with increasing soil compaction towards the rear end of the frame 8, so that the difference in settlement between adjacent compacting tools provides a measure of the compaction effect of the rearward one of the succession of compacting tools. The difference in settlement between adjacent compacting tools can therefore advantageously be used as the control quantity for the compacting procedure. The amplitude and, if appropriate, frequency, of vibration of each tool are varied in the direction to maximize the settlement produced by that tool, or the differential settlement relative to the immediately preceding compacting tool. Thus optimum adaptation of the individual compacting tools to the existing soil consistency is ensured.

It is also desirable to use the difference in settlement between adjacent tools for controlling the traveling speed of the machine. In this respect, if, for example, the settlement after the passage of a certain number of compacting tools no longer increases, the remaining compacting tools have no effect. Thus, as shown in FIG. 4, the difference in settlement, $\Delta a$, between the two last compacting tools 6 and 7 is used as the control quantity for the speed of travel. If it is smaller than the required set value, the speed of travel is increased, and if it is higher, then the speed of travel is decreased, until the set value is obtained. In this respect, it is also clearly within the scope of the invention to use the difference in settlement not at the extreme end but, for example, between the second from last and third from last compacting tools, i.e. tools 5 and 6.

Several possibilities exist for measuring the difference in settlement, without difficulty. If the compacting tools to be measured are of the same size and have the same vibration amplitude, the heights of the centers of oscillation of adjacent tools may be directly compared with each other. In contrast, if there is a difference in size, the positions of the lower points of vibration direction reversal of the compacting tools must be compared with each other. For this, inductive measuring methods are preferred.

Suitable hydraulic drive systems for driving each compacting tool to have an adjustably controllable vibration amplitude and frequency are disclosed in my U.S. Pat. No. 3,849,986 issued on Nov. 26th, 1974. Several embodiments of compacting machines having the form shown in FIG. 4 are disclosed in my pending U.S. application Ser. No. 745,451 entitled APPARATUS FOR GROUND COMPACTING, filed on Nov. 26th, 1976, and claiming priority of German application P 25 53 778.4 of Nov. 29th, 1975.

Thus, the invention offers the advantages of being applicable to all contemplated dynamic compacting methods, both with regard to time of operation and with regard to the equipment parameters, i.e. vibration amplitude and frequency, and provides a substantially more uniform soil compaction than was heretofore attainable.

Supplementary to the discussion appearing in the SUMMARY OF THE INVENTION, the following must be pointed out relating to the compaction power used as control quantity: Measurement is made of a value which is proportional to the power being transmitted to the compacting tools. In case however, the degree of soil settlement is used as a measure for the compaction efficiency, then the measured value corresponds to the power produced on the soil by the tools.

Figure 5:
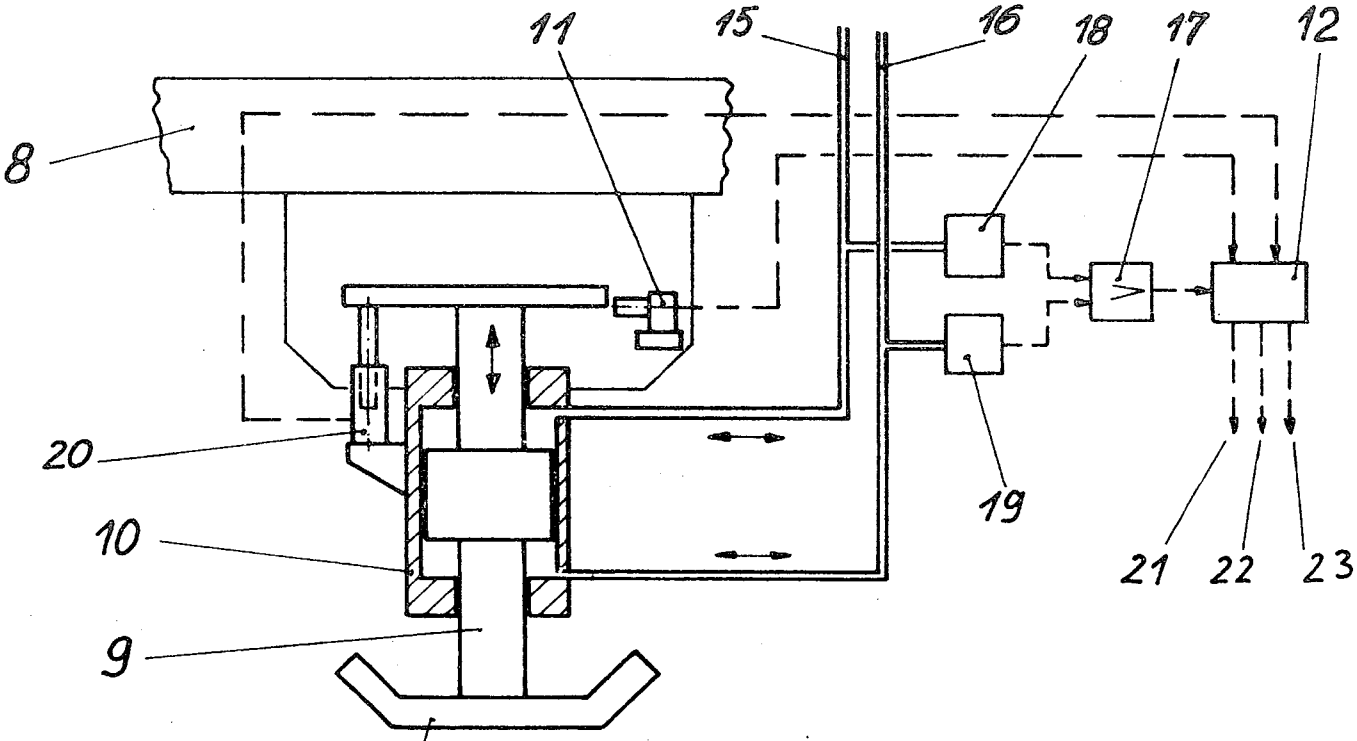
FIG. 5 is a diagrammatic view illustrating a system for power measurement of a single compacting tool.

FIG. 5 shows an example of an advantageous application of oscillating compacting tools and a diagrammatical illustration of the measuring equipment. At the end of the piston rod 9 of the tool 1 . . . 7, which rod is supported in cylinder 10 for vibrating movement, there is an inductive impulse counter 11, transmitting at every cycle of the tool an electric pulse to the control system composed of a computer 12. The feed lines 15 and 16 for the pressure medium being delivered by a non-illustrated pressure source are connected with the pressure transducers 18 and 19. The pressure transducers emit electric signals proportional to the working pressure and these signals are applied to an amplifier 17, which derives mean pressure value signals that are amplified and compared with each other during an oscillation period. The resulting difference signal is transmitted into the computer 12 in form of a signal and then, together with the signals from the impulse counter 11 transformed into a comparative value signal representing the power acting on the soil. The loss of efficiency of the working parts, due to friction, is automatically eliminated by the computing of the difference value.

The amplitude of oscillation of the tool mass is produced by the pulsating pressure medium flow, which is led through the lines 15 and 16. The non-illustrated pressure source is preferably formed by a pumping device having the form shown in FIGS. 4 and 6 of my U.S. Pat. No. 3,849,986. The quantity of fluid delivered per cycle of revolution, as described, can be varied from zero to a maximum by means of a phase displacement of a cylinder unit and thus the amplitude of tool oscillation is changed proportionally while the frequency is held constant.

For the purpose of maximizing the efficiency of each of the tools 1 . . . 7, for instance at the start of a pass, the tool amplitude is increased from zero to the maximum value by varying the pulsating pump flow while holding the frequency constant. At the same time the efficiency is continuously measured as above described. Simultaneously the present values of the tool oscillation amplitudes are derived by means of a displacement transducer 20 and stored into the computer. While sweeping the amplitude spectrum, the computer stores the corresponding power output values and after reaching the maximum amplitude, by means of a suitable elementary program, determines the amplitude which corresponded to the highest power output. This amplitude value is used by the computer as starting signal 21 applied to known control elements, by which the pump apparatus selects the corresponding feed quantity for the desired amplitude. The derived nominal value is to be fixed and used for keeping the tool oscillation amplitude constant during a working pass.

In applicant's experience, the variation of the oscillating frequency does not have as great an influence on the compacting effect as has the amplitude variation. There exists however the possibility of frequency variation with the arrangement of FIG. 5. The frequency variation is preferably carried out directly after determining the optimal oscillation amplitude. By varying the rate of pump rotation within the limit range the tool frequency is also altered and the measured values, such as pressure difference and pulse rate, are continuously stored. When reaching the minimum or maximum frequency, the computer 12 selects that frequency which represents the maximum value for the pressure difference. As a signal 22, the computer provides the nominal value for the regulation of the pump rotation rate e.g. by varying the rate of rotation of the pump driving motor with known final control elements.

The object of the present invention is to reach the desired compaction with one pass by an expedient application of several tools arranged in tandem. For this reason it is necessary to provide the computer with the limit value quantity of the efficiency increase, by providing, for instance, the values between the last and second from last or third from last compacting tools. During the pass the values representing the efficiency are continuously stored by the computer from the efficiency difference between the adjacent compacting tools. For example: If the instantaneous value falls below the set nominal value, the computer emits the signal 23 which induces the operator to reduce the traveling speed. It goes without saying that compaction can also be carried out by one single tool but with several passes. In this case the compacting progress is measured at the beginning of the new pass by comparing the efficiency increase against the stored efficiency level of the previous pass, e.g. after changing the direction of travel, whereat the same is given into the computer in form of a signal initiating the above-mentioned efficiency comparison.

Preferably the signal 23 is to be used to regulate automatically the traveling speed of the compacting tool via a known final control element, e.g. an element sold for this purpose under the type designation FLBR by Moog GmbH, Boblingen, Federal Republic of Germany. A corresponding indicator is recommended in order to inform the operator that the apparatus is operating at optimal efficiency. This indicator can be constituted by indicator device 34 disclosed in U.S. Pat. No. 3,256,798, issued to de Bissi on June 21st, 1966.

Figure 6:
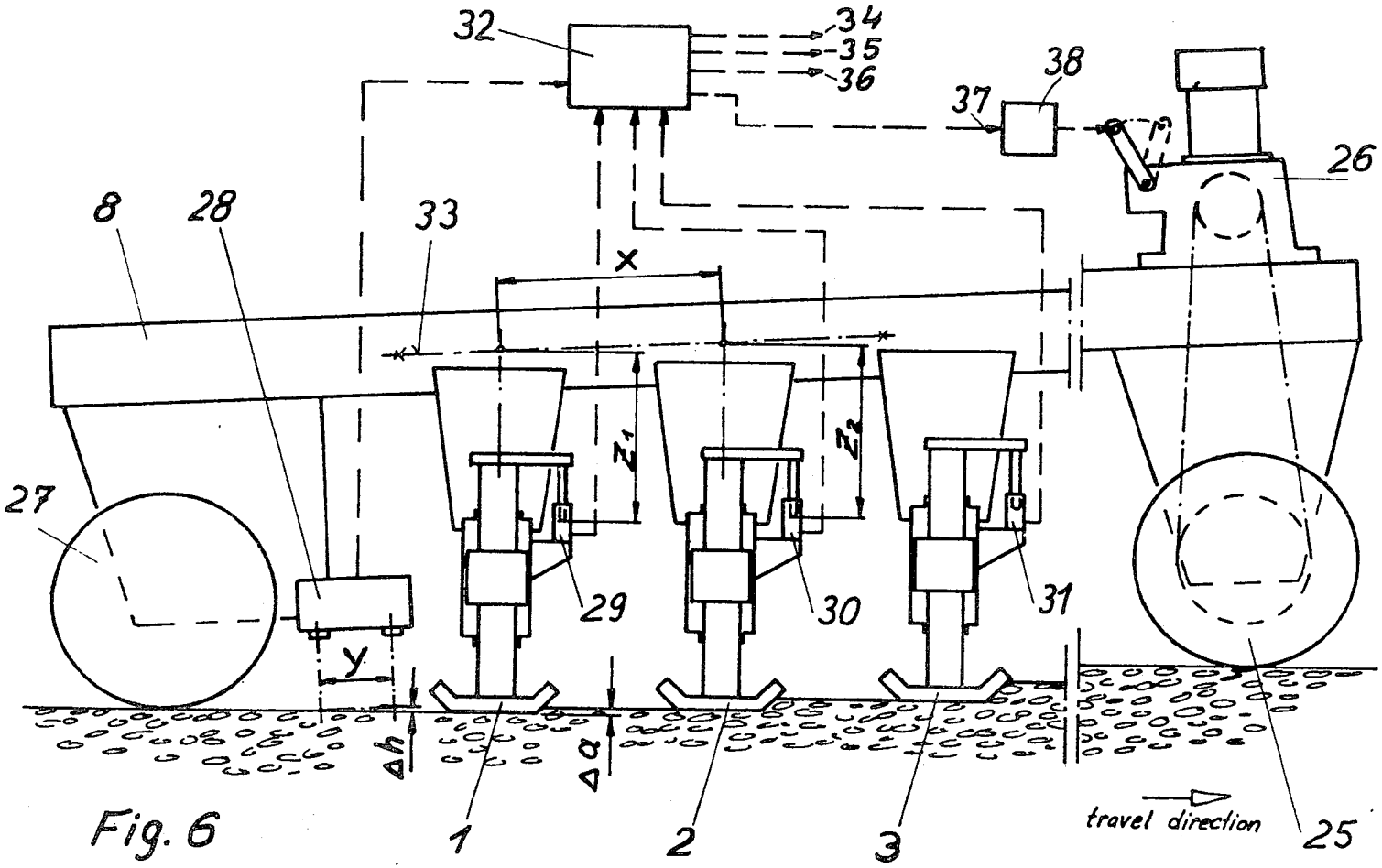
FIG. 6 is diagrammatic view illustrating an arrangement of several tools in a self-propelled frame, including a measuring system for deriving settlement values.

FIG. 6 illustrates the principle of the settlement measurement according to the invention, used for the determination of the compacting result. FIG. 6 shows an example of a particularly advantageous application of several tools and a diagrammatical illustration of the measuring method based on soil settlement. The tools 1, 2, 3 and further ones are supported by the frame 8 and the tools 1 and 2 used for the settlement comparison measurement have a given longitudinal spacing X. The driving axle 25 is located at the front of the machine with the driving unit 26 and the supporting axle 27 arranged at the rear of the frame. A measuring device 28 is attached between the last tool 1 and the supporting axle 27 in order to record the inclination of the frame 8 relative to the ground underneath due to the total settlement. The measurement of the inclination, for instance, is carried out by taking the distance between a certain frame reference plane and the soil surface at at least two measuring points arranged in the direction of travel with a spacing Y. For these procedures photo-electric measurement-methods or ultrasonics should preferably be used. The value $\Delta h$ are compared by the computer and converted to a quantity for the inclination. The tools 1, 2, 3 are equipped with inductive displacement transducers 29, 30, 31 which detect the distances Z between the lower oscillation inversion points and a certain frame reference plane 33 and deliver resulting measuring values to the computer 32. At the beginning of the pass, the efficiencies of the individual tools are maximized according to the procedure described with reference to FIG. 5: The amplitudes and frequencies are modified one after the other, the actual highest Z value is adjoined to the here concerned values and then fixed as the optimal amplitude and frequency values, by means of the signals 33, 34 and 35, in the non-illustrating pump aggregates of the tools. Then the measuring values delivered by the transducers 29, 30 are substracted from one another, by the computer 32, and taking into consideration the inclination value, the result is corrected according to the following formula:

$$\text{settlement: } \Delta a = Z_1 - Z_2 + h \cdot (x/y).$$

This settlement value can be emitted by the computer in form of a corresponding signal during the compacting procedure, so that the operator can adapt the travel speed to the value of the desired settlement. The measuring value $\Delta a$ of the settlement is advantageously compared in the computer with a predetermined nominal value for the nature of the soil, after which the computer emits a signal 37 that regulates the travel speed by influencing the driving unit via known final control elements 38. Finally it must be pointed out that derivation of the above mentioned measuring values are frequently subjected to disturbance influences in practice because of the existence of unhomogeneous soil conditions. These disturbance influences can likely cause a rapid rising or falling of the hydraulic pressure in the feeding lines of the tools during the measurement of power according to the procedure described with reference to FIG. 5.

When using the settlement measuring method conforming to FIG. 6, it can happen that the distances measured by the transducers between the lower inversion points of the tools and the frame reference plane can change rapidly. In the same way the inclination measurement could be falsefied, so that instantaneous unhomogeneous soil conditions in the compacted surface are measured and exploited.

The elimination of these disturbance influences, according to the invention, is carried out by providing limiting values to the computer relative to the time-depending change of the measuring quantities. The conditions for the limiting value consideration by the computer can mean that after an increase of the considered measuring value within a certain time interval, there must follow a corresponding decrease, or vice versa. If these conditions are realized, the total variation is filtered out and levelled for the further exploitation of the measuring value series. Another possibility involves a common controltechnical application of a corresponding damping component in the transmission of the measuring values, effectuation of maximum reduction in, or elimination of, the variation being unusual for this procedure.

The specific limiting value condition for the actual material to be compacted, together with the other given nominal values, such as: settlement, efficiency limiting value, initial velocity, are fed into the computer at the beginning of the working procedure.

It will be understood that the above description of the present invention is susceptible to various modifications, changes and adaptations, and the same are intended to be comprehended within the meaning and range of equivalents of the appended claims.

What is claimed is:

1. In a method for compacting soil by supplying energy to a plurality of compacting tools in a manner to cause the tools to undergo individual vertical vibratory movements and to strike the soil surface while they travel along a path, the tools being spaced apart in the direction of travel, the improvement comprising: monitoring one of the amount of settlement of the compacted soil at the soil surface and the vibrational power supplied to the tools by measuring the difference in height between corresponding points of adjacent tools when each is at the lowest point of its vibratory movement; and controlling the supply of energy to the tools in order to vary the amplitude of the vibratory movements of the tools in dependence on the monitoring result in a direction to maximize the resulting degree of soil compaction.

2. A method as defined in claim 1 wherein the tools are hydraulically operated and the energy is supplied by a hydraulic pressure medium.

3. A method as defined in claim 1 wherein said step of monitoring includes producing a signal when the magnitude of such difference is below a selected value.

4. A method as defined in claim 1 wherein the tools are caused to traverse a path a plurality of times as they undergo vertical vibratory movements, and said step of monitoring includes determining the change in the monitoring result between successive traversals of the path.

5. A method as defined in claim 1 wherein said step of controlling is carried out in immediate response to the result produced by said monitoring step.

6. A method as defined in claim 1 wherein said step of controlling further comprises varying the frequency of the vibratory movement of the tools in a direction to maximize the resulting degree of soil compaction.

7. A method as defined in claim 1 wherein said step of monitoring includes determining the change in the measured height difference as the tools travel along the path, and said step of controlling is carried out in immediate response to the result produced by said monitoring step.

8. A method as defined in claim 1 wherein said step of monitoring comprises generating a signal representing the measured height difference, and passing the signal through a disturbance filter for eliminating transient signal variations having less than a predetermined amplitude.

9. A method as defined in claim 1 wherein said step of measuring is carried out by inductive means.

10. In apparatus for compacting soil and including support means arranged to travel upon the soil, a plurality of compacting tools supported by the support means and spaced from one another in the direction of travel, and vibratory drive means connected to the tools for impacting an independent vertical vibratory movement to each tool to cause the tool to strike the soil surface, the improvement comprising: monitoring means mounted on said support means for measuring the difference between the soil levels produced by two of said tools in the direction of travel of said support means in order to monitor the degree of soil compaction being produced by said tools; and amplitude control means connected between said monitoring means and said tools for controlling the supply of energy to said tools in order to vary the amplitude of the vibratory movements of said tools in dependence on the monitoring result in a direction to maximize the resulting degree of soil compaction and for varying the speed of travel of said support means as a function of the result produced by said monitoring means.

11. An arrangement as defined in claim 10 wherein said control means comprise a control circuit operatively associated with each said tool for varying the amplitude of vibration of said tool in a direction to cause said tool to produce maximum soil compaction.

12. An arrangement as defined in claim 10 wherein said control means comprise a control circuit operatively associated with each said tool for varying the frequency of vibration of said tool in a direction to cause said tool to produce maximum soil compaction.

* * * * *